US007350532B2

(12) United States Patent
Wu

(10) Patent No.: US 7,350,532 B2
(45) Date of Patent: Apr. 1, 2008

(54) PORTABLE COLLAPSIBLE TENT

(76) Inventor: Weidan Wu, Wuao Village, Gaojian Town, Sanmen County, 317100, Ningbo, Zhejiang Province (CN)

( * ) Notice: Subject to any disclaimer, the term of this patent is extended or adjusted under 35 U.S.C. 154(b) by 222 days.

(21) Appl. No.: 11/180,408

(22) Filed: Jul. 12, 2005

(65) Prior Publication Data

US 2005/0241688 A1 Nov. 3, 2005

Related U.S. Application Data

(63) Continuation-in-part of application No. 10/897,069, filed on Jul. 21, 2004, now abandoned.

(30) Foreign Application Priority Data

Jul. 24, 2003 (CN) ..... 03 2 55950 U

(51) Int. Cl.
*E04H 15/48* (2006.01)

(52) U.S. Cl. ..... 135/144; 135/135; 135/139; 135/147

(58) Field of Classification Search ..... 135/121, 135/130–131, 135, 139–140, 143–147, 159, 135/151
See application file for complete search history.

(56) References Cited

U.S. PATENT DOCUMENTS

| | | | | |
|---|---|---|---|---|
| 1,666,757 | A * | 4/1928 | Snyder | 135/146 |
| 4,558,713 | A * | 12/1985 | Hagler et al. | 135/159 |
| 4,779,635 | A * | 10/1988 | Lynch | 135/97 |
| 5,035,253 | A | 7/1991 | Bortles | 135/119 |
| 5,274,980 | A | 1/1994 | Zeigler | 52/646 |
| 5,275,188 | A * | 1/1994 | Tsai | 135/97 |
| 5,701,923 | A * | 12/1997 | Losi et al. | 135/131 |
| 5,711,337 | A | 1/1998 | McKenney | 135/121 |
| 5,797,412 | A | 8/1998 | Carter | 135/145 |
| 5,944,040 | A | 8/1999 | Jang | 135/126 |
| 6,089,247 | A | 7/2000 | Price | 135/145 |
| 6,173,726 | B1 * | 1/2001 | Talmadge | 135/144 |
| 6,283,136 | B1 * | 9/2001 | Chen | 135/144 |

(Continued)

FOREIGN PATENT DOCUMENTS

GB 2289291 A * 11/1995

(Continued)

*Primary Examiner*—Winnie Yip
(74) *Attorney, Agent, or Firm*—Tianhua Gu; Global IP Services

(57) ABSTRACT

A portable collapsible tent includes a cover, a roof frame with a central pole, inclined roof ribs and spreaders, extensible legs, and cross bars. The ribs and spreaders are pivotally and movably jointed at the central pole. A locking unit secures the roof frame when the tent is pitched. Each leg has at one end a fixed corner member that provides a four-way connection and a multi-way support member that movably engages and locks onto the leg to support two cross bars and an inclined rib connected thereto with three diagonal braces. A spring is positioned on the central pole to enable the collapsed tent to be opened easily. A lateral projecting foot member enables each leg to be anchored on the ground. Reinforcement ropes further secure the tent to the ground via the four-way connectors. The portable collapsible tent can be easily set up and collapsed without tools and has a strong structural integrity, able to withstand substantial stress and direct/indirect forces.

17 Claims, 5 Drawing Sheets

U.S. PATENT DOCUMENTS

| | | | | |
|---|---|---|---|---|
| 6,345,639 | B2 | 2/2002 | Rousselle et al. | 135/128 |
| 6,397,872 | B1 | 6/2002 | Carter | 135/145 |
| 6,581,617 | B2 * | 6/2003 | Ham et al. | 135/135 |
| 6,708,707 | B2 * | 3/2004 | Dotterweich et al. | 135/131 |
| 6,748,963 | B2 | 6/2004 | Carter | 135/145 |
| 6,772,780 | B2 * | 8/2004 | Price | 135/131 |
| 6,779,538 | B2 * | 8/2004 | Morgante et al. | 135/128 |

FOREIGN PATENT DOCUMENTS

| | | | | |
|---|---|---|---|---|
| JP | 11062323 | A | * | 3/1999 |
| JP | 2002227454 | A | * | 8/2002 |
| JP | 2003227249 | A | * | 8/2003 |

* cited by examiner

PORTABLE COLLAPSIBLE TENT

CROSS REFERENCE TO RELATED APPLICATION

This application is a continuation-in-part of U.S. patent application Ser. No. 10/897,069 which was filed Jul. 21, 2004, now abondoned.

BACKGROUND OF THE INVENTION

1. Field of the Invention

This invention relates generally to portable shelters and more particularly to a novel frame construction enabling tool-less easy set up and fast collapsing of a portable shelter, tent, canopy, screen room, porch, shade, or the like.

2. Description of the Related Art

Two well known types of temporary shelters exist in the art—an assembling-type and a collapsible-type. Anyone who has assembled or has tried to assemble a temporary shelter knows the frustration and manual labor involved. The assembling-type requires certain tools, such as wrenches, screwdrivers, mallets, and so on, to put together various assembling members or parts that could easily be miss-placed, lost, or broken. A clear drawback is that, even if only a small part is missing, the structural integrity of the entire shelter may be adversely affected.

Moreover, since the fasteners such as screws and nuts must be individually tightened during the initial assembly, and then retightened to insure stability, setting up an assembly-type temporary shelter can be very time-consuming. Consequently, a large number of labor hours are generally needed. As one can expect, the complication, frustration, and consumption of time and energy are somewhat proportional to the size of the structure. Thus, the larger the frame construction, the harder and longer the set up would be.

The collapsible-type has merit over the assembly-type because, among others, it eliminates the tedious and time-consuming manual assembly procedure. In general, a collapsible tent is faster to set up/break down, easier to maintain, and more suitable for portable use. However, some drawbacks still exist in currently available collapsible tents. For example, sometimes it can be difficult to open a collapsible tent on site. Also, existing collapsible shelters often have weak wind-resist capability. Moreover, current collapsible shelters are generally bulky and/or heavy and therefore are not very convenient or suitable for outdoor use.

SUMMARY OF THE INVENTION

It is therefore an object of the present invention to provide a novel portable collapsible tent frame assembly, which needs neither special tools nor additional hardware, and which does not use any screw engaging member.

Another object of the present invention is to provide a portable collapsible shelter, tent, canopy, screen room, porch, shade, or the like, that is capable of withstanding substantial stress and direct/indirect forces such as what would be imposed by severe wind, rain and other weather and environmental conditions.

Yet another object of the present invention is to provide a portable collapsible shelter, tent, canopy, screen room, porch, shade, or the like, that is capable of being easily manipulated between a collapsed position and an expanded, locked position without compromising the structural integrity thereof.

These and other objects of the present invention are achieved in a portable collapsible tent comprising a roof frame system with a cover thereon. The roof frame system has a central rib-holder pole with a crown member securely attached on top thereof and a plurality of inclined ribs, each having a corresponding adjustable side leg joined with a corresponding corner member thereof. The ribs are arranged radially from the crown member and extend downwardly to the side legs, connecting the crown member and the side legs.

The roof frame system further includes a central hinge unit coaxially movably attached to the lower portion of the central rib-holder pole. The central hinge unit has a spreader holder and a locking unit. The spreader holder is hinged with a plurality of spreaders for opening and collapsing the tent. The locking unit locks the spreader holder and hence the spreaders when the tent is pitched.

All the connections between the crown member and the inclined ribs, and between the spreader holder and the spreaders are pivotal connections. Each spreader connects the spreader holder with an inclined rib at a hinge joint positioned at the center of the rib.

The spreader holder has a positioning lock-hole thereon for accommodating a retractable locking pin laterally projecting from the tube wall of the central rib-holder pole. The locking pin is spring-biased with one end of the spring attached or fixed onto the inner wall of the hollow tubular body of the central rib-holder pole. The locking pin and the positioning lock-hole constitute the locking unit.

The portable collapsible tent further comprises a plurality of cross bar members, each of which consists of two bars jointed with a hinge that allows the two bars to be fully folded in a compact position. Each cross bar member preferably has the hinge joint positioned at the central point thereof. Each cross bar member is movably attached, at its opposite ends, to two corner members, each of which is securely attached or fixed at the upper end of a corresponding side leg. Preferably, a corner member is a four-way connector movably connecting two cross bar members and an inclined rib to its side leg.

The side legs support the overall collapsible tent in an upright position and are preferably telescopically extensible for adjusting the height of the tent. In some embodiments, each side leg has a telescopic bar member and each side leg has at least one through-hole at the lower portion for receiving and engaging one or more retractable locking pin or stub protruding from the telescopic bar member. The retractable locking pin or stub is spring-biased with one end of the spring fixed or otherwise securely attached to the inner tube wall of the telescopic bar member.

At the bottom of the telescopic bar member, a laterally projecting foot member with one or more through-hole enables the tent to be anchored on the ground with stakes, metal posts, or other anchoring means. Preferably, each side leg or its telescopic bar member also has one or more holes and/or hooks at the lower portion where the cover or the tail hooks thereof can be secured.

The portable collapsible tent advantageously includes a plurality of multi-way support members, each of which is movably attached to a side leg. Each multi-way support member has three hinge connected diagonal braces supporting an inclined rib and two mutually intersected cross bar members. The three diagonal braces have their downward ends pivotally joined at one point on the multi-way support member. Each multi-way support member has a locking through-hole for accommodating and engaging a retractable locking pin or knob, which is spring-biased with one end thereof fixed to the side leg at one or more predetermined positions.

In some embodiments, the portable collapsible tent has a generally rectangular shape with four sets of side legs, cross bar members, spreaders, and inclined roof ribs. One skilled in the art will appreciate that, as the number of the component sets changes, other shapes of the tent are possible and are therefore within the scope of the invention.

To reinforce the strength of the tent against wind and other undesired weather and environmental conditions, in some embodiments, reinforcement ropes are used to tie or otherwise secure the four-way connectors to the ground via anchoring means.

According to an aspect of the invention, the cover has one or more viscous ribbons, tapes, or the likes along each cross bar member to provide releasable bonding between the cover and the portable collapsible tent. Still further objects and advantages of the present invention will become clear to one of ordinary skill in the art upon reading and understanding the detailed teachings of exemplary embodiments described below with reference to the following drawings.

DETAILED DESCRIPTION OF THE DRAWING

DETAILED DESCRIPTION OF THE PREFERRED EMBODIMENTS

Figure 1:
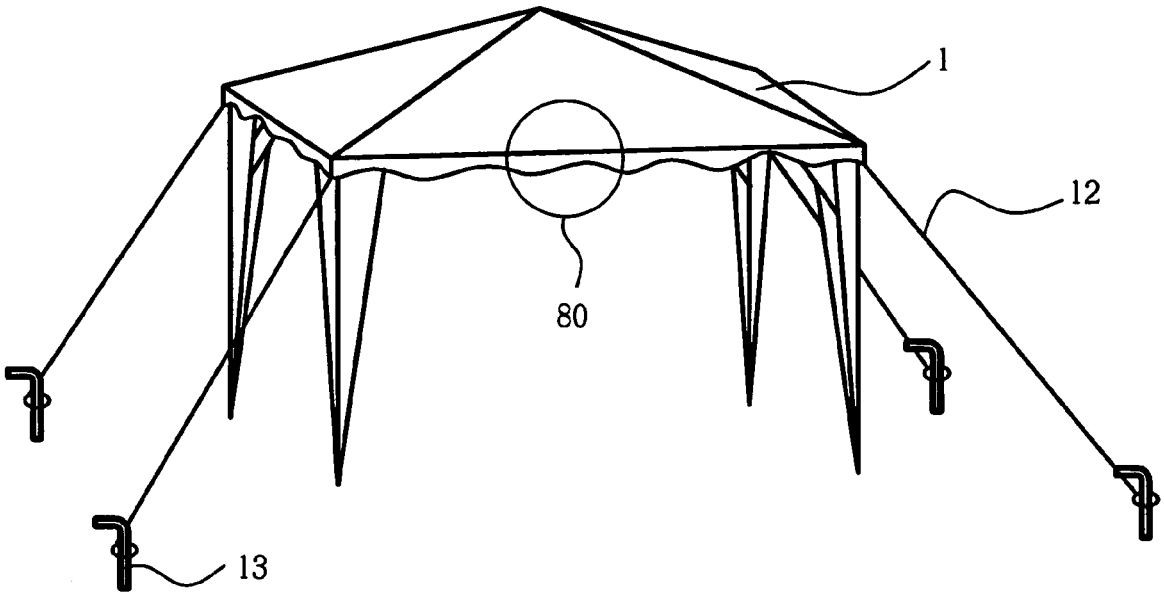
FIG. 1 is a perspective view of the first embodiment of the present invention.
Figure 2:
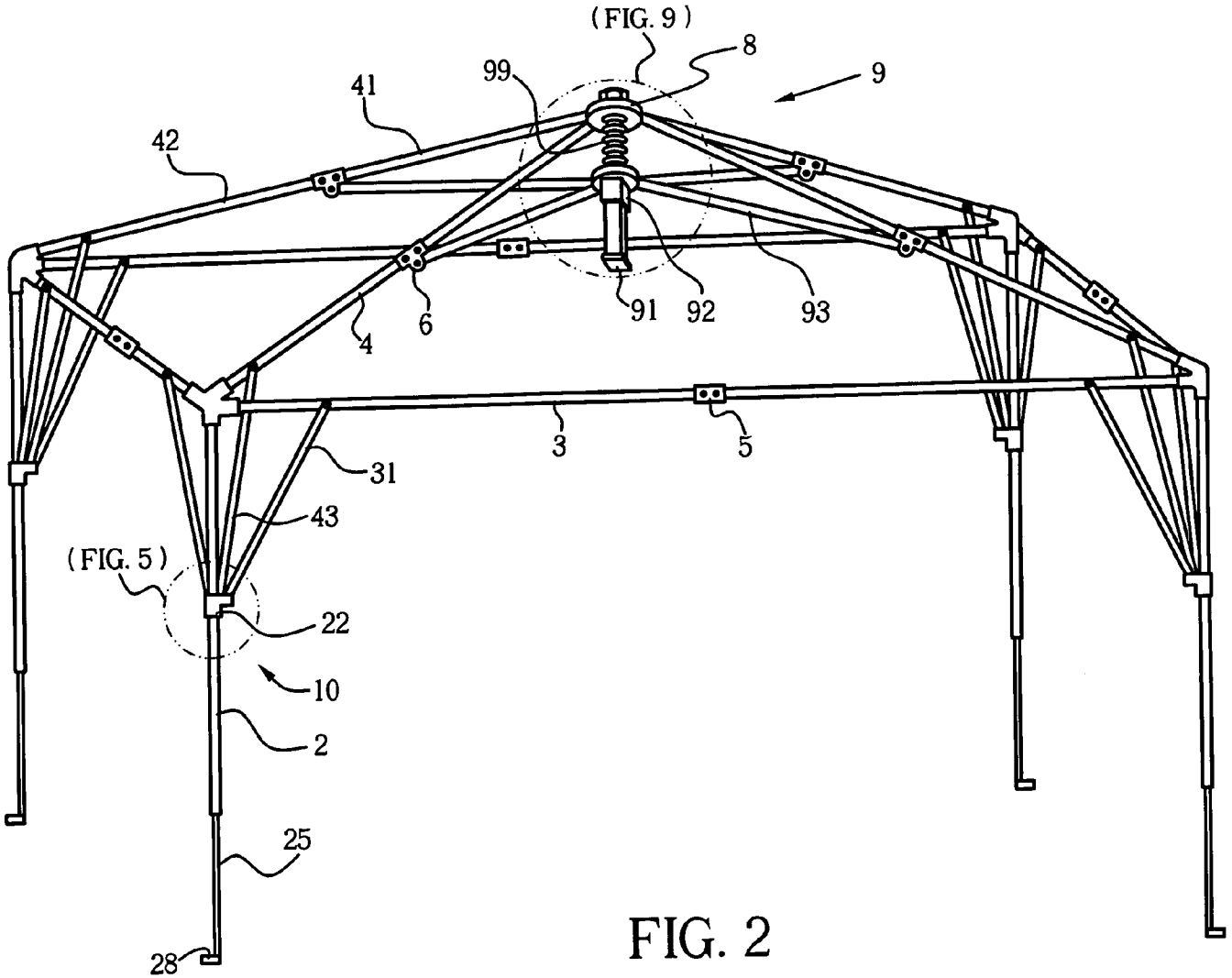
FIG. 2 is perspective view of the first embodiment with the cover removed, illustrating the overall frame in opened (pitched) condition.

In FIG. 1 and FIG. 2, a preferred embodiment of the present invention is constructed of a collapsible tent frame assembly capable of being manipulated between a collapsed position and an expanded, locked position. The portable collapsible tent comprises a roof frame system 9, a cover 1, side legs 2, and cross bar members 3.

The cover 1 is made of a flexible material such as cloth and covers the roof frame system 9, which has at its center a central rib-holder pole 91. A crown member 8 is fixed at the top position of the pole 91. A plurality of inclined ribs 4 are arranged radially from the crown member 8 and extend downwardly to their corresponding side legs 2.

In this example, each inclined rib 4 consists of two preferably equal-length bars or members 41 and 42 connected via a hinge joint 6 positioned at the central point of the inclined rib 4. The hinge joint 6 enables the two members 41 and 42 to be fully collapsible in a compact manner. The hinge joint 6 also forms a hinge connection with a spreader 93, allowing the spreader 93 to be collapsible with the two members 41 and 42 in a compact manner.

Each of the four inclined ribs 4 further forms hinge connections at its two opposite ends respectively with a corner member 7, positioned at the upper end of the corresponding leg 2, and with the crown member 8, positioned at the top of the central rib-holder pole 91. The inclined ribs 4 support the cover 1 when the tent is pitched.

The roof frame system 9 includes a spreader holder 92 hinged with a plurality of spreaders 93 for opening, maintaining, and collapsing the tent. As a central hinge unit, the spreader holder 92 has a lock means thereon and is coaxially movably attached to the central rib-holder pole 91 at its lower end. The lock means securely locks the spreader holder 92 onto the pole 91 when the tent is pitched.

All the connections between the crown member 8 and inclined ribs 4, and between the plurality of spreaders 93 and the spreader holder 92 are pivotal connections. The connections between the inclined ribs 4 and the corner members 7 of the side legs 2, and between the inclined ribs 4 and the spreaders 93 are also pivotal hinged ones.

Figure 3:
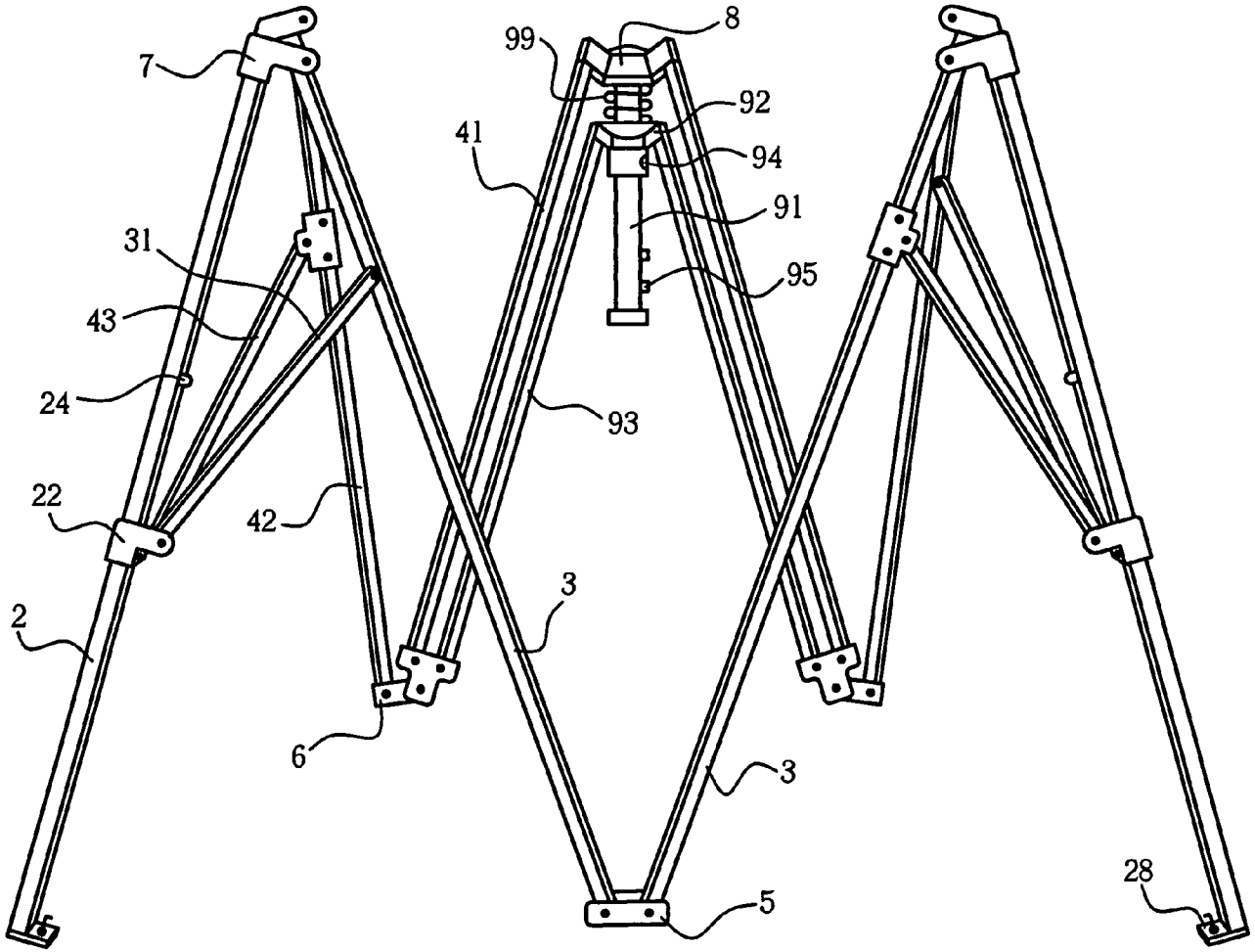
FIG. 3 is a partially broken away perspective view of the first embodiment in a collapsing condition.
Figure 4:
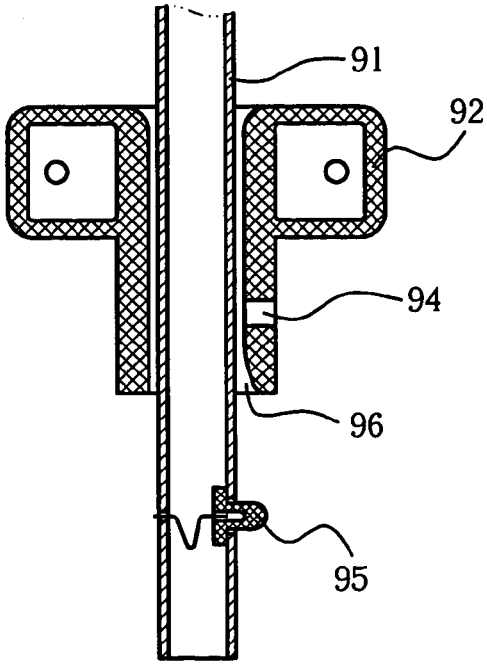
FIG. 4 is a longitudinal section view, fragmentally illustrating the spreader holder movably joining and engaging the central rib-holder pole.

Referring to FIG. 3 and FIG. 4, the spreader holder 92 has a positioning lock-hole 94 thereon for accommodating a retractable locking pin or stub 95 protruding laterally from the central rib-holder pole 91. The retractable stub 95 is spring-biased with one end of the spring fixed or otherwise attached to the inner wall of the hollow tubular body of the central rib-holder pole 91. The locking pin 95 and the positioning lock-hole 94 constitute a locking unit of the spreader holder 92. Preferably, the spreader holder has an inclined portion 96 under the positioning lock-hole 94 for facilitating the locking pin 95 to enter and engage the positioning lock hole 94.

In this example, each of the four cross bar members 3 consists of two preferably equal-length bars connected by a hinge joint 5. The hinge joint 5 enables the bars to be fully collapsible in a compact manner and automatically locked in a fully extended position when the tent is pitched. Each cross bar member 3 at its two opposite ends has a respective hinge joint connecting a corner member 7 securely positioned at the upper end of a side leg 2.

The four side legs 2 support the portable collapsible tent in an upright position and are preferably telescopically extensible. In some embodiments, each leg 2 has a telescopic bar member 25 for adjusting the height of the tent and a laterally projecting foot member 28 for anchoring the tent. Each leg 2 also has at its upper end a four-way connector or corner member 7 affixed or securely attached thereto. In this embodiment, the corner member 7 provide hinge connections for four components, i.e. a leg 2, an inclined rib 4 and two cross bar members 3, in one corner, hence the namesake.

Figure 5:
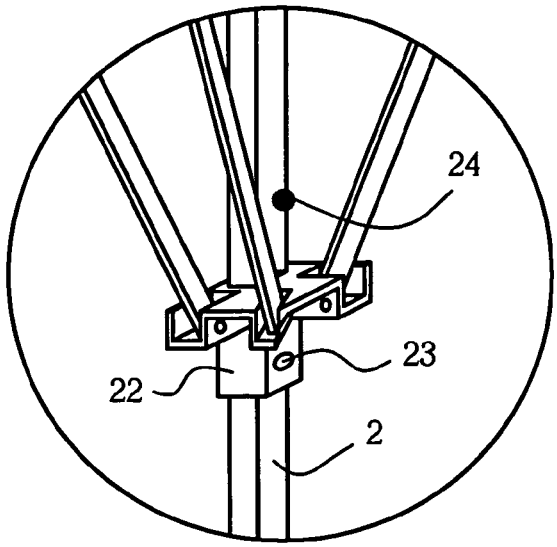
FIG. 5 is a perspective view showing a multi-way connector with three diagonal braces movably attached to a side leg.

Each leg 2 has a multi-way support system 10, which includes a multi-way support member 22 and three braces 31, 31', and 43. As illustrated in FIGS. 3 and 5, the multi-way support member 22 is movably attached to the leg 2 and has a positioning lock-hole 23 for receiving and engaging one or more locking pin 24 positioned on the leg 2. The locking pin 24 and the positioning lock-hole 23 are similar to the locking pin 95 and the positioning lock-hole 94, respectively.

The braces 31 and 31' movably connect the multi-way support member 22 and the pivot points positioned on two cross bars 3 and support the two cross bars 3 when the tent is pitched. The brace 43 movably joins the multi-way support member 22 and an inclined rib 4 and supports the inclined rib 4 when the tent is pitched.

Figure 6:
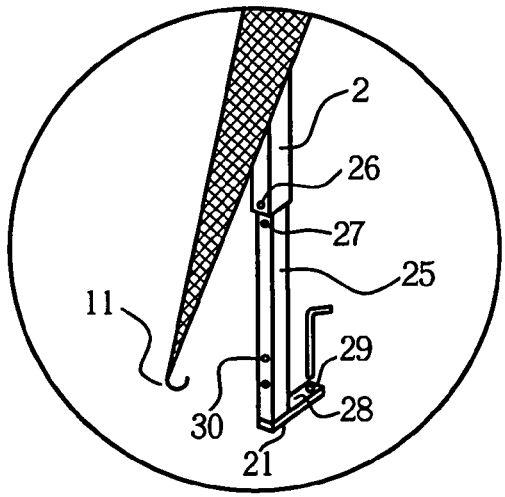
FIG. 6 is an enlarged fragmentary view illustrating the engagement between the cover hook and the through-holes disposed at the bottom part of the telescopic bar member of a side leg.
Figure 7:
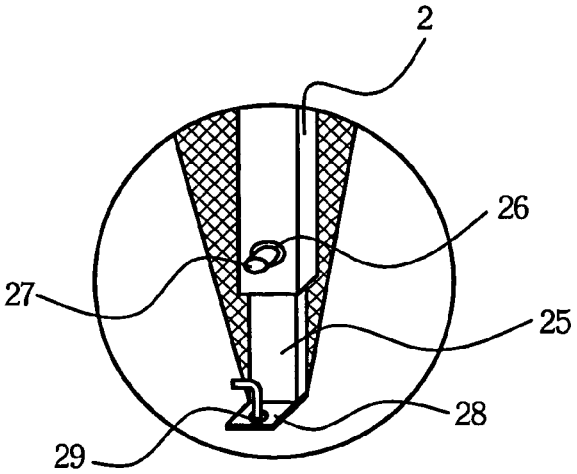
FIG. 7 is an enlarged fragmentary view illustrating the engagement between the cover, lower portion of the leg and the telescopic bar.

FIG. 6 and FIG. 7 show different implementations of the lower portion of a leg 2. For example, the leg 2 can have a telescopic bar member 25 with one or more retractable spring-biased locking pins 27 positioned thereon to provide a positioning and locking engagement with the leg 2. One or more through-holes 30 positioned at the lower end of the telescopic bar member 25 receives and securely engages a hook 11 of a tail of the cover 1. The leg 2 may or may not have corresponding through-holes aligned with the holes 30 . Laterally projecting from the bottom 21 of the telescopic bar member 25 is a foot member 28, on which a through hole 29 is positioned for anchoring via one or more anchoring means 29 such as stakes, hooks, nails, or the likes.

At the lower end of the leg 2, one or more lock-holes 26 are arranged to receive and securely engage the one or more retractable locking pins 27 of the telescopic bar member 25. The locking pins 27 and/or the lock-holes 26 may be positioned at a fixed interval.

Figure 8:
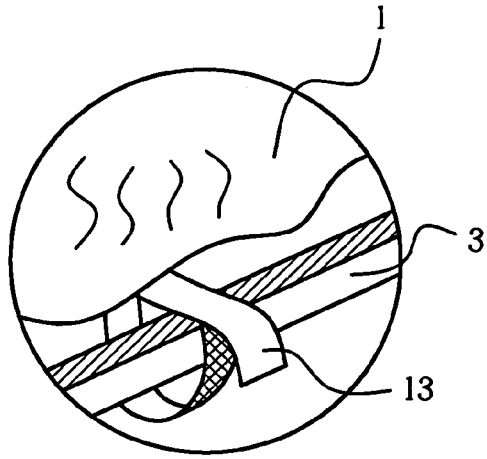
FIG. 8 is an enlarged fragmentary view illustrating the cover with its viscous ribbon tied up with the crossbar member.

To secure the cover 1 to the portable collapsible tent, the cover may include a plurality of fasteners, such as viscous ribbons, strings, ties, tapes, hooks, loops, and the likes, disposed along the cross bars and/or other appropriate components to provide a releasable bonding between the cover and the tent. FIG. 8 is an enlarged fragmentary view 80 of FIG. 1, illustrating the cover 1 being securely attachable to a cross bar member 3 via a fastener 13.

Figure 9:
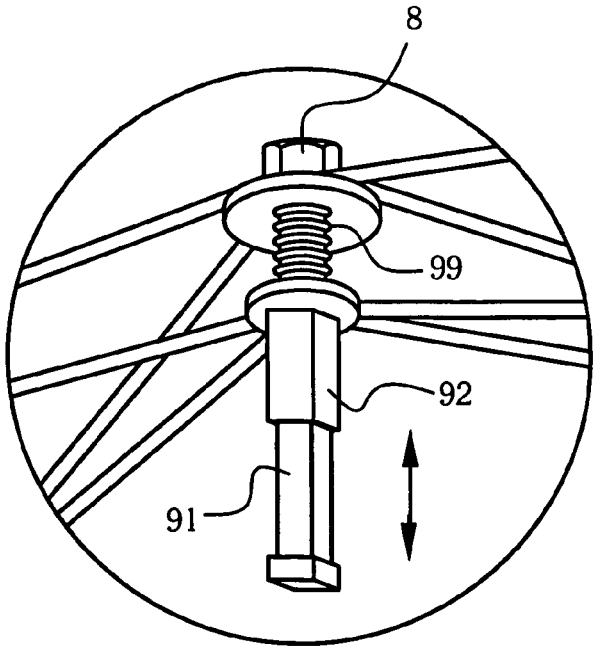
FIG. 9 is a perspective view showing of another preferable embodiment; a spring is positioned on the central rib-holder pole and the spring forces the collapsed frame to open.

FIG. 9 shows that a spring 99 is positioned on the central rib-holder pole 91. One end of the spring 99 is against the crown member 8, the other end is against the spreader holder 92. When the tent is in a collapsed position, the spring 99 is compressed. Therefore, the spring 99 pushes the spreader holder 92 outward to help the collapsed tent to open. It brings big convenience to people for opening the tent. FIG. 9 shows the cross section of the central rib-holder pole 91 is a square. However, the cross section can be a rectangle or a circle or an ellipse.

As illustrated in FIG. 1, to reinforce the strength of the tent against stress and forces such as those caused by severe wind and weather conditions, reinforcement ropes 12 are used to tie or otherwise secure the four-way connectors 7, disposed on top of the legs 2, with ground anchoring means 13 such as nails, stakes, posts, or the likes. As such, when the tent is pitched, the inclined ribs 4, the spreaders 93, the cross bar members 3, the multi-way support members 22, and the legs 2 are all locked into positions. The tent is firmly secured to the ground via the foot members 28 and stakes 29 and reinforced with ropes 12 and nails 13.

As one skilled in the art will appreciate, the present invention offers many advantages over existing products. A main advantage is its compact construction, which allows the tent to rapidly and conveniently pitched and collapsed without using any tools and screw-type engagements. The novel frame construction provides a strong structural integrity against undesired weather conditions such as severe wind. In addition, a collapsible tent constructed according to the present invention is easy to transport and takes up less storage space.

Although the present invention and its advantages have been described in detail, it should be understood that the present invention is not limited to or defined by what is shown or described herein. As one of ordinary skill in the art will appreciate, various changes, substitutions, and alterations could be made or otherwise implemented without departing from the principles of the present invention. For example, the present invention is not limited to any particular materials. The components described above can be fabricated using commonly available materials and machines. The dimension and weight of a portable collapsible tent of the present invention can therefore vary depending on the materials used and/or application desired. In addition, although the drawings disclosed herein show a somewhat rectangular shaped tent with four sets of side legs, cross bar members, spreaders, and inclined roof ribs, other shapes are possible as the number of sets increases to five or more or decreases to three. Accordingly, the scope of the present invention should be determined by the following claims and their legal equivalents.

The invention claimed is:

1. A portable collapsible tent comprising:

a roof frame system having
- a cover over said roof frame;
- a central rib-holder pole;
- a crown member securely attached to the top of said central rib-holder pole;
- a plurality of inclined ribs movably attached to and extending radially from said crown member;
- a spreader holder coaxially and movably attached to said central rib-holder pole;
- a plurality of spreaders extending radially from said spreader holder and movably attached to said spreader holder and to said inclined ribs;

a plurality of cross bars, each of which having two members movably joined via a hinge joint that enables said members fully collapsible in a compact manner; and a plurality of side legs for supporting said portable collapsible tent in an upright position; wherein each leg has
- a corner member securely attached to the top of said leg and movably joining one of said inclined ribs and two of said cross bars; and
- a multi-way support system comprising
  - a multi-way support member coaxially positioned over said leg; and
  - three diagonally positioned braces movably jointing said multi-way support member with one of said inclined ribs and two of said cross bars;

a spring is positioned on said central rib-holder pole for opening said collapsed tent.

2. The portable collapsible tent of claim 1, wherein said inclined ribs form hinge connections in a downward direction with said crown member, said spreaders, and said legs.

3. The portable collapsible tent of claim 1, wherein each of said inclined ribs has two equal-lengths elements movably connected via a hinge joint that enables said elements fully collapsible in a compact position.

4. The portable collapsible tent of claim 3, wherein said hinge joint movably connects said elements with one of said spreaders and enables the same fully collapsible.

5. The portable collapsible tent of claim 1, wherein said spreaders are movably attached to each of said inclined ribs at its mid point.

6. The portable collapsible tent of claim 1, wherein said central rib-holder pole has one or more retractable locking pin and said spreader holder has one or more corresponding positioning lock hole for receiving and securely engaging said locking pin; wherein said central rib-holder pole has a hollow body with an inner wall and an outer wall; and wherein said locking pin is spring-biased with one end thereof securely attached to said inner wall and the other end protruding outside said outer wall of said central rib-holder pole.

7. The portable collapsible tent of claim 1, wherein said braces form hinge connections between said multi-way support member and a respective pivot point positioned on each of said cross bars.

8. The portable collapsible tent of claim 1, wherein said multi-way support member has one or more retractable locking pin and said leg has one or more corresponding positioning lock hole for receiving and securely engaging said locking pin; wherein said leg has a hollow body with an inner wall and an outer wall; and wherein said locking pin is spring-biased with one end thereof securely attached to said inner wall and the other end protruding outside said outer wall of said leg.

9. The portable collapsible tent of claim 1, wherein each of said legs is telescopically extensible and has one or more locking means for securely adjusting the height of said tent.

10. The portable collapsible tent of claim 1, wherein said corner member is a four-way connector.

11. The portable collapsible tent of claim 1, wherein each of said legs has one or more receiving means at its lower end to accommodate and secure a tail hook of said cover.

12. The portable collapsible tent of claim 1, wherein said members have an equal length; and wherein said hinge joint is capable of automatically locking said members in a fully extended position.

13. The portable collapsible tent of claim 1, wherein each of said legs has a foot member with at least one through-hole thereon to receive one or more anchoring means for firmly securing said tent to ground or a permanent fixture.

14. The portable collapsible tent of claim 1, wherein each of said legs has a telescopic bar; wherein said leg has one or more retractable locking pin and said telescopic bar has one or more corresponding positioning lock hole for receiving and securely engaging said locking pin; wherein said telescopic bar has a hollow body with an inner wall and an outer wall; and wherein said locking pin is spring-biased with one end thereof securely attached to said inner wall and the other end protruding outside said outer wall of said telescopic bar.

15. The portable collapsible tent of claim 14, wherein said telescopic bar has one or more receiving means at its lower end to accommodate and secure a tail hook of said cover.

16. The portable collapsible tent of claim 15, wherein said cover has a plurality of fastener means disposed along said cross bars for releasable bonding between said cover and said cross bars.

17. The portable collapsible tent of claim 1, wherein the cross section of said central rib-holder pole is a square.

* * * * *